United States Patent [19]

Andersson

[11] Patent Number: 4,911,303

[45] Date of Patent: Mar. 27, 1990

[54] STACKABLE RECTANGULAR CRATE, ESPECIALLY FOR BOTTLES

[75] Inventor: Kjell Andersson, Gyllenlackvägen, Sweden

[73] Assignee: AB Tetra Pak, Lund, Sweden

[21] Appl. No.: 183,298

[22] Filed: Apr. 11, 1988

Related U.S. Application Data

[63] Continuation of Ser. No. 905,184, Sep. 9, 1986, abandoned.

[30] Foreign Application Priority Data

Sep. 25, 1985 [SE] Sweden ..... 8504418

[51] Int. Cl.[4] ..... B55D 21/02

[52] U.S. Cl. ..... 206/507; 206/507; 206/511; 206/512; 220/21; 211/126

[58] Field of Search ..... 206/507, 509, 511, 512, 206/505, 506; 220/21; 211/126

[56] References Cited

U.S. PATENT DOCUMENTS

| | | | |
|---|---|---|---|
| 951,902 | 3/1910 | Boyd | 206/511 |
| 1,947,055 | 2/1934 | Moorma | 206/511 |
| 3,081,897 | 3/1963 | Livingston | 206/511 |
| 3,425,594 | 2/1969 | Briderstine | 206/507 |
| 4,478,156 | 10/1984 | Andersson . | |
| 4,600,103 | 7/1986 | Tabler | 206/507 |

FOREIGN PATENT DOCUMENTS

| | | | |
|---|---|---|---|
| 2624890 | 12/1977 | Fed. Rep. of Germany | 220/21 |
| 445598 | 5/1975 | U.S.S.R. . | |

*Primary Examiner*—George E. Lowrance

*Attorney, Agent, or Firm*—Burns, Doane, Swecker & Mathis

[57] ABSTRACT

A stackable rectangular crate (1), especially for bottles (6), comprising a box-type part with a bottom (3) and sidewalls (4,5), two opposite sidewalls (4) of which are higher than the two other sidewalls (5). Two supporting elements (7), forming extensions of the higher sidewalls (4), extend downwardly from the bottom (3) and terminate in straight horizontal edges (8). The crate thus has an H-shaped profile. At the upper parts of the higher sidewalls (4) stacking elements are provided which comprise on the one hand shoulders (9) adapted to support the supporting elements (7) of another crate (2) stacked from above, and on the other hand projections (10) which extend upwardly from the higher sidewalls (4) and along the whole length thereof, and extend at the corners of the crate (1) by means of short sections (11) a short way along the lower sidewalls (5). In accordance with the invention the projections (10) are adapted to surround outwardly the supporting elements (7) of another crate (2) stacked from above. Moreover, the projections (10) and the shoulders (9) are dimensioned so as to admit such obliquity of the upper crate (2) that it can be shifted on the shoulders (9) of the lower crate (1) parallel with the higher sidewalls (4).

12 Claims, 3 Drawing Sheets

STACKABLE RECTANGULAR CRATE, ESPECIALLY FOR BOTTLES

This application is a continuation of application Ser. No. 06,905,184, filed Sept. 9, 1986, now abandoned.

FIELD OF THE INVENTION

The present invention generally to storage crates and, more particularly to a stackable rectangular crate, especially for bottles.

BACKGROUND OF THE INVENTION

A known stackable rectangular crate of the above-mentioned type intended for milk packages has proved advantageous in many respects. Thus it is possible in the transport of crates to make use of their supporting elements as runners on a roller conveyor or as guides if the crate is adapted so that the supporting elements adjoin a conveyor track. The lower recess in the crate permits the transport of stacked crates by means, for example, of a fork lift truck without any load pallet adapted for the purpose being required. The stackability of the crates makes possible the stacking of an optional number of crates in a transport vehicle, so that any space available in them in the direction of height can be utilized. At the point of sale the goods, milk products, are clearly displayed to the consumer, thanks to the recesses in the crate. Moreover, the upper recess facilitates the picking out of goods from the crate. In the return transport of empty crates these can be stacked, every other crate in the stack being twisted by 90°, the bottom of every other crate resting against the lower sidewalls of the crate located immediately underneath it. In this way the space required for stacked empty crates is considerably reduced.

Advantages described above of the known crate can be obtained also on a similar sort of H-profiled crate especially adapted for bottles. In addition to this, further advantages are obtained compared to the handling of bottles by means of conventional bottle crates, which usually are of a square bot-type form and which are dimensioned for 25 bottles. These advantages will be illustrated in the following.

Since the consumption of beverages is seasonal, the surplus of beverages produced by the breweries is stored during the low season. In the stores the conventional bottle crates are stacked on loading pallets in units of generally 45 crates distributed over nine stacks with five crates in each stack. The stacks are so oriented on the load pallets that each side of the loading units has three stacks. Several such loading units, usually three, can be stacked onto one another. Since each loading pallet is constructed with three horizontal supporting beams, with one of the beams being located right in the centre under the loading pallet, the said centermost beam in a loading unit will exercize pressure on the centermost wall sections of certain of the crates in another unit located underneath. It is possible for the pressure from one or several loading units to destroy the said underlying bottle crate, since the stress can become too great on the centremost wall portions where a bottle crate is least capable of transmitting vertical forces.

A similar loading unit consisting of stacked crates with H-profile requires no loading pallet for its handling. The legs of a fork lift truck make use directly of the lower recess on the crates located nethermost for the lifting of the whole loading unit. The loading units in a stack of loading units may be simply kept apart by means of discs. As a result the vertical forces which act upon stacked crates with H-profile always will be transmitted substantially evenly distributed by the higher sidewalls and the supporting elements of the crates. There is no risk, therefore, of a harmful concentrated loading at the center of the sidewalls.

Beer and refreshing beverages are produced in many different brands. In a stack of crates with H-profile, where the crates contain different kinds of beverages, these can be visualized, thanks to the recesses in the crates. It is not necessary, therefore, as in the case of conventional containers, to assort the crates so that each stack contains the same brand. The consumer will still be able to identify a brand, irrespectively of the position of the crate in the stack, and the consumer, moreover, will be able to pick bottles from optional crates in the stack.

Frequently the consumer will purchase wholly filled bottle crates. To this end an already full crate is often chosen which is topmost in a stack. When a conventional box-type bottle crate is to be lifted from the top of a stack of bottle crates, which are surrounded on three sides by other stacks, it is possible first to pull out the bottle crate a short distance in lateral direction, with its bottom sliding on the sidewalls of the bottle crate located directly underneath. When the bottle crate has been pulled out so far that it is partly free of the stacks of bottle crates close by, it can be lifted off with the help of handles, now accessible, which are provided in the sidewalls of the bottle crate.

On stacking the known crate with H-profile described above on a similar crate the supporting elements of the upper crate rest against shoulders which are situated on the outside of the sidewalls of the lower crate. The supporting elements of the upper crate here surround the sidewalls of the lower crate telescopically, so that the crates are fixed against shifting in lateral direction in relation to each other.

It is a disadvantage when the known crate with H-profile is to be lifted off from a similar stacked position, which is described above for the conventional box-type, that the known crate first has to be lifted so high from the crate lying directly underneath it that the supporting elements will be situated above the sidewalls of the lower crate. When the upper crate thus made free subsequently is passed sideways out of the stack, there is a great risk of the supporting elements dipping down into the lower crate and knocking against the goods in the same. Moreover, it is difficult manually to grip the crate so that lifting is possible if the same is surrounded on three sides by other crates.

OBJECTS AND SUMMARY OF THE INVENTION

It is object of the present invention to try to overcome the aforementioned disadvantage of the known crate with H-profile on manual handling of stacked crates of this type. It is a further object to adapt the known crate so that it becomes suitable for storage and transport of bottles.

These objects are achieved in accordance with the invention by means of a stackable rectangular crate characterized mainly in that the shoulders extend horizontally and linearly along substantially the whole length of the higher sidewalls; that projections are provided to surround outwardly the supporting elements of another crate stacked from above; and that the shoulders and projections are dimensioned so as to permit such obliquity of an upper crate stacked from above that its supporting elements nearest to one of the lower sidewalls are situated higher than the said sections of the projections of the lower crate, whilst the same supporting elements nearest to the other lower sidewall continue to rest upon the shoulders of the lower crate, a shifting of the upper crate parallel with the higher sidewalls, following thereupon, being possible through its supporting elements sliding on the shoulders of the lower crate and on said sections of its projections.

Thus it is made possible in an advantageous manner manually to remove a crate from the top of a stack of crates without any risk of the supporting elements knocking against the bottles in the crate lying directly underneath. Moreover, only a small lifting force is required for freeing the crate situated uppermost from the one directly underneath.

By placing the uppermost crate in an oblique position so that its supporting elements nearest to one of the lower sidewalls are higher than the sections of the projections of the lower crate, it is possible to shift the upper crate out of the stack whilst its supporting elements slide on the shoulders of the lower crate and on the said sections of its projections. During the sideways shifting of the upper crate its supporting elements are guided against the inside of the projections of the crate situated directly underneath. In this manner any dipping down of the supporting elements among the bottles in the lower crate is prevented. The upper crate is pulled out in this manner from the stack to such an extent that it becomes accessible to be gripped in order to lift it off the stack.

In accordance with a preferred embodiment of the crate according to the invention the projections extend upwards from the shoulders, the shoulders being adapted to support the straight horizontal edges of supporting elements of another crate stacked from above. As a result the loads from the stacked crates are transmitted in a favourable manner in vertical direction through the higher sidewalls and supporting elements of the crates. The whole cross-sectional area of the supporting elements can also be utilized in the transmission of forces in vertical direction.

It is also possible to form necks on the outside of the supporting elements, the necks being adapted to rest against the projections of another crate stacked from below. The stop edges of the projections constitute the said shoulders., This embodiment, however, is not so appropriate, since load forces on stacked crates are not only transferred in vertical direction. Moreover, only the cross-sectional areas of the projections and of the shoulders of the supporting elements can be made use of in the transmission of the loads.

BRIEF DESCRIPTION OF THE DRAWINGS

The invention is explained in greater detail in the following description with reference to the attached drawing in which.

DETAILED DESCRIPTION OF A PREFERRED EMBODIMENT

Figure 1:
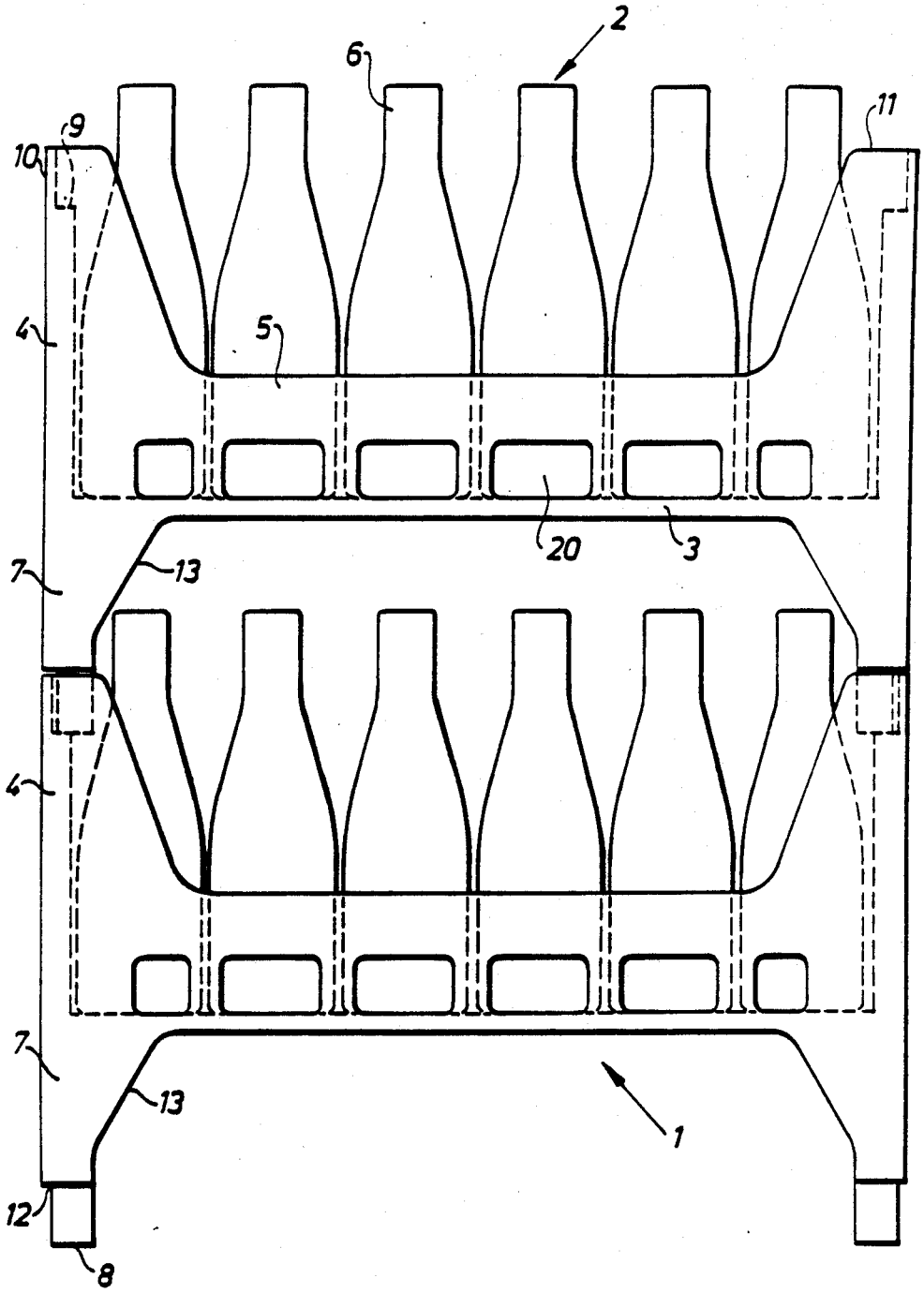
FIG. 1 is an elevational view of the longitudinal sides of two stacked crates in accordance with the invention which are filled with bottles.

In FIG. 1 are shown two stacked rectangular crates 1 and 2, each comprising a box-type part open at the top with a bottom 3 and sidewalls which are substantially at right angles to the bottom. Two opposite sidewalls 4 are higher and shorter than the other two sidewalls 5 but lower than the bottles 6 which are supported on the bottom 3. The higher sidewalls 4 are provided with extensions forming supporting elements 7 which extend downwards from the bottom 3 and terminate in substantially straight horizontal edges 8. These extend along the respective higher sidewalls 4. Consequently the longitudinal side of the crate presents an H-profile with recesses situated above and below the bottom respectively which exhibit the bottles 6 and are dimensioned so that picking out of bottles from the lower crate shown in FIG. 1 is possible.

In the upper parts of the higher sidewalls 4 are provided stacking elements comprising shoulders 9, which extend horizontally and linearly along substantially the whole length of the higher sidewalls 4, and which are adapted to support the supporting elements 7 of another crate stacked from above. Furthermore the stacking elements comprise projections 10 which extend upwards from the higher sidewalls 4 and along substantially the whole length of these, and extend at the corners of the crate by means of short sections 11 a short way in the direction along the lower sidewalls 5. The projections 10 extend upwards from the shoulders 9 and are adapted to surround outwardly the supporting elements 7 of another crate stacked from above. The shoulders 9 are adapted to support the straight horizontal edges 8 of the supporting elements 7 on the said other crate stacked from above.

The crate is provided in each corner with an outer neck 12 directed downwards in the vicinity of the stop edge 8 of the supporting element, but at a distance from the same which is at least equal to the height of the projection 10. The neck 12 runs from the corner of the crate on the supporting element on the one hand parallel along the lower sidewall 5, on the other hand by means of a short section a short way parallel along the higher sidewall 4. In FIG. 1 are shown the necks 12 of the upper crate 2 resting upon the projections 10 of the lower crate 1. The purpose of this is to distribute the vertical forces which act from the upper crate upon the lower crate 1, so that the said forces are transmitted to the grater part through the corners of the lower crate 1. However, the necks 12 are not necessary and the crate may be without them.

For the purpose of stiffening the crate is provided with braces 13 between the supporting elements 7 and the bottom 3 in the plane of the longitudinal sidewalls 5. The dimensions of the said braces 13 are so adapted to the tapering shape of the bottles 6 that the braces cannot knock against the bottles in the event of a relative sideways shifting between stacked crates in the direction perpendicular to the lower sidewalls 5.

Figure 2:
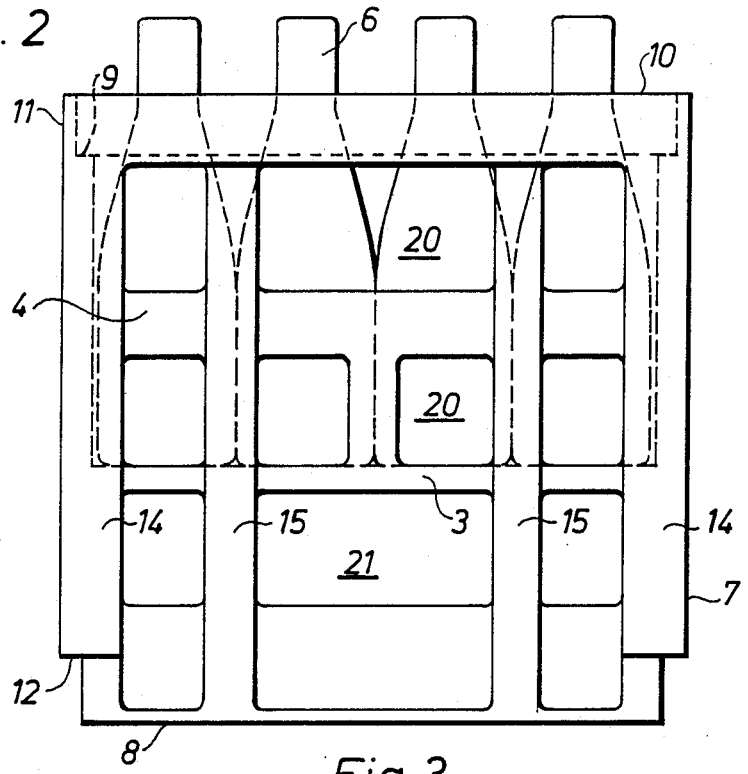
FIG. 2 shows a view of the short side of a crate in accordance with the invention provided with bottles.
Figure 3:
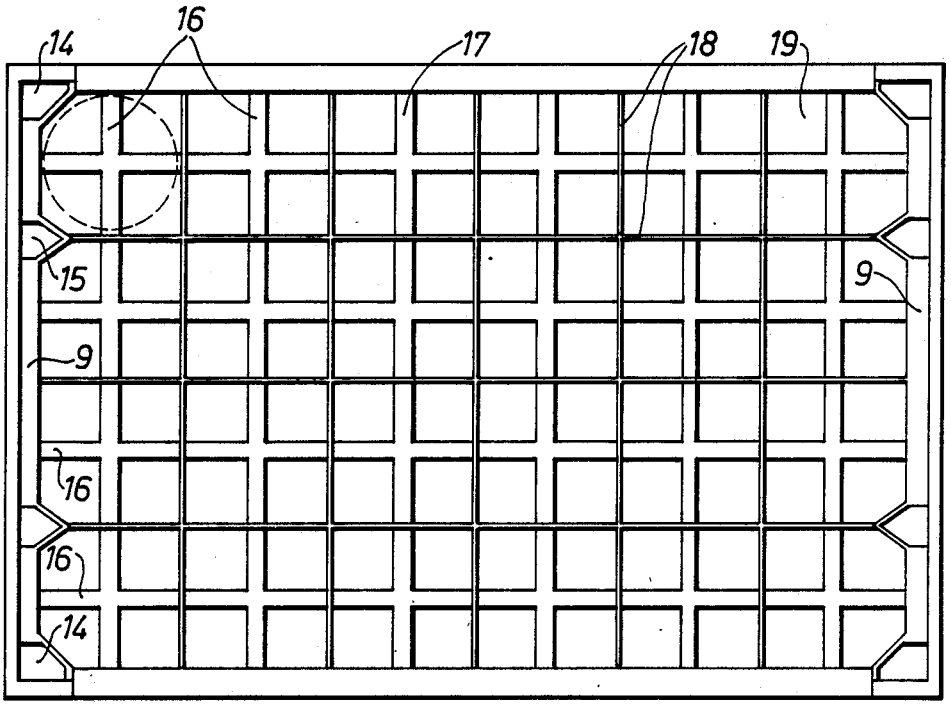
FIG. 3 is a top plan view of the same crate but unfilled.

In each higher sidewall 4 are provided four hollow reinforcement pillars 14,15 (FIG. 2) which extend substantially vertically from the top edge of the higher sidewall 4 to the horizontal edge 8 of the supporting element 7. Two of the pillars 14 are arranged at the corners of the crate. The two other pillars 15 are arranged in the vicinity of the two respective corner pillars 14. The said other pillars 15 may also have a limited extent from the top edge of the sidewall 4 so that they terminate at the bottom 3 of the crate. The pillars 14,15 are designed with substantially triangular cross-section, but other forms of cross-sections are also possible (FIG. 3).

Since bottles usually have a circular cross-section, free spaces are formed between the bottles when they are standing on the bottom 3 of the crate. These spaces close to the higher sidewalls 4 are made use of in such a way that the pillars 14,15 are accommodated in the said spaces.

The bottom of the crate comprises beams 16 extending parallel with the sidewalls 4 and 5 which form crosses 17 situated exactly underneath the bases of the bottles in a crate filled with bottles. Furthermore the bottom of the crate comprises a number of compartments 19 divided by means of vertical walls 18 which corresponds to the number of bottles contained in the crate (FIG. 3). The walls 18 are intended to fix the bottles and to hinder them from sliding about on the bottom during handling of a not completely filled crate. The torsional strength of the crate is also improved by the walls 18.

The sidewalls 4,5 of the crate have a number of windows 20 intended on the one hand to display the bottles, on the other hand to affect the strength of the crate in a favourable manner. The supporting elements 7 too have windows 21 which extend up to the bottom 3 of the crate. The windows 21 are intended to permit the introduction of a lifting element underneath the bottom 3 of the crate.

Figure 4:
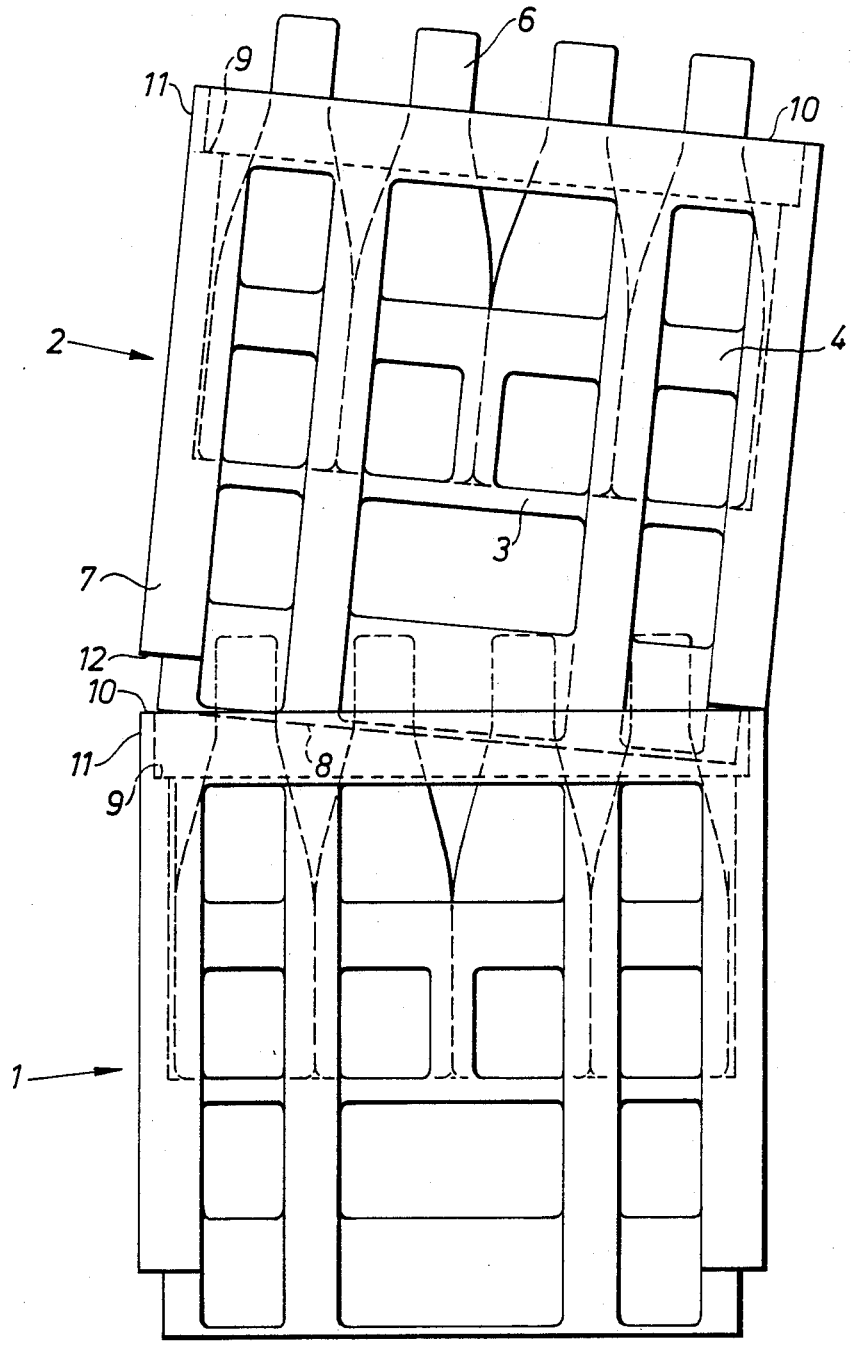
FIG. 4 is an elevational view of the short sides of the stacked crates in accordance with FIG. 1 with the upper crate placed in oblique position on the lower one.

In FIG. 4 is shown an upper crate 2 placed in oblique position on a lower crate 1, so that the supporting element 7 at the left corner of the upper crate 2 is at a level above the projection 10 of the lower crate 1. For such an obliquity to become possible the shoulders 9 and the projections 10 are so dimensioned that no locking can occur between the supporting elements 7 on the upper crate 2 and the short sections 11 of the projections on the lower crate 1. Consequently, either the shoulders 9 have a certain minimum possible length along the higher sidewalls 4 in relation to the length of the supporting element 7 and the height on the short sections 11 of the projections 10, or else the short sections 11 of the projections 10 have a certain maximum possible height in relation to the length of the supporting elements 7 and the length of the shoulders 9. The two alternatives are illustrated by the following mathematical relationships:

$$L \geqq \frac{1}{2} \sqrt{H^2 + A^2}$$

$$H \leqq \frac{1}{2} \sqrt{L^2 - A^2}$$

wherein

L=the length of the shoulders 9 along the higher sidewalls 4.

H=the height of the short sections 11 of the projections 10.

A=the length of the supporting element 7.

The crates altogether contain 24 bottles distributed in the crates, with six rows along the lower sidewalls 5 and four rows along the higher sidewall 4. In this manner a favourable form of crate is obtained. Empty crates can thus be stacked with every other crate in the stack being twisted by 90° and with the bottom of every other crate resting against the lower sidewalls of the crate located immediately underneath. In this manner empty crates can be stacked more compactly than if they are stacked with the same angular orientation. It also becomes easier to carry the crates manually, since their center of gravity will be located closer to the carrier than the center of gravity of, for example, square crates.

On stacking filled crates in loading units a loading unit appropriately can contain 40 crates distributed in eight stacks of five crates in each stack. The stacks are oriented so that the sides of the loading units contain two stacks and four stacks respectively. The side which contains two stacks will then display the long sides of the crates so as to make possible the introduction of the legs of a fork lift truck into the lower recess of the lowermost crates to lift them off the loading unit.

While this invention has been illustrated and described in accordance with a preferred embodiment, it is recognized that variations and changes may be made and equivalents employed therein without departing from the invention as set forth in the claims.

What is claimed is:

1. In a stackable rectangular crate for bottles, of the type having the shape of a box with an open top, a bottom, first and second pairs of opposing side walls meeting at corners, said first pair of opposing side walls being higher than the side walls of said second pair of sidewalls, said crate being adapted to hold bottles taller than said first pair of opposing side walls, two supporting elements in the form of extensions of said first pair of opposing side walls which extend downwardly from said bottom and terminate in substantially straight horizontally edges extending along the side walls of said first pair of opposing side walls, and stacking elements at upper parts of said first pair of opposing side walls, said stacking elements having shoulders adapted to support supporting elements of another crate stacked from above, and projections extending upwardly from said first pair of opposing side walls and extending along substantially the entire length of the side walls of said first pair of opposing side walls, said projections having sections extending a short distance along the side walls of said second pair of opposing side walls at said corners, the crate thus presenting an H-shaped profile with recesses above and below said bottom which are intended for the display of bottles placed on said bottom and dimensioned to allow the picking out of bottles from any of a plurality of stacked crates, the improvement comprising:

reinforcement pillars being provided at the corners formed between said first and second pairs of side walls and further reinforcement pillars are provided intermediate said corners along each of the side walls of said first pair of side walls;

said shoulders extending horizontally and linearly along substantially the entire length of the side walls of said first pair of opposing side walls, said projections being adapted to outwardly surround the supporting elements of another crate stacked from above, said shoulders and said projections being dimensioned to permit such obliquity of another crate stacked from above that its supporting elements nearest to one of the side walls of said second pair of opposing side walls are situated higher than said sections of said projections of the lower crate, while the supporting elements nearest to the other side wall of said second pair of opposing side walls continue to rest upon said shoulders of the lower crate, a subsequent shifting of the crate stacked from above in a direction parallel to the upper edges of said first pair of side walls being possible through its supporting elements sliding on said shoulders of the lower crate on said sections of said projections, said shifting being capable of being carried out without disturbance of any bottles which may be contained within said lower crate due to the combined space created between the first pair of opposing side walls of the lower crate and the two supporting elements of the upper crate.

2. The stackable rectangular crate according to claim 1, wherein said plurality of reinforcement pillars extend substantially vertically from the shoulders of the side walls of said first pair of side walls toward said bottom.

3. The stackable rectangular crate according to claim 3, wherein said reinforcement pillars have a pentagonal cross-sectional shape as viewed in a vertical direction.

4. The stackable rectangular crate according to claim 1, wherein said shoulders have a length along the side walls of said first pair of side walls which is dimensioned relative to the length of said supporting elements and the height of said projection sections in accordance with the relationship:

$$L \geqq 1/2\sqrt{H^2 + A^2}$$

wherein;

L=the length of said shoulders,

H=the height of said projection sections, and

A=the length of said supporting elements.

5. The stackable rectangular crate according to claim 1, wherein said projection sections have a height which is dimensioned relative to the length of said shoulders along the side walls of said first pair of said walls and the length of said supporting elements in accordance with the relationship:

$$H \leqq 1/2\sqrt{L^2 - A^2}$$

wherein;

L=the length of said shoulders,

H=the height of said projection sections, and

A=the length of said supporting elements.

6. A stackable crate in accordance with claim 2, wherein said projections extend upwardly from said shoulders said shoulders being adapted to support the straight horizontal edges of supporting elements of another crate stacked from above.

7. A stackable crate for use in carrying and displaying bottles, comprising:

a rectangular bottom having four corners;

a first pair of opposing side walls extending upwardly from said bottom;

a second pair of opposing side walls extending upwardly from said bottom and being connected with said first pair of opposing side walls at corners extending upwardly from the corners of said bottom, said first pair of opposing side walls extending higher above said bottom than said second pair of opposing side walls, each of the side walls of said first pair of side walls having a shoulder extending along substantially the entire length thereof and a projection extending upwardly from said shoulder along substantially the entire length of said shoulder, said projections extending upwardly a first fixed distance and having a top surface, each of the side walls of said second pair of opposing side walls including projection sections which are connected with the projections on adjacent ones of the side walls of said first pair of opposing side walls and which extend upwardly to the same height as said projections so that each of said shoulders is bordered by two of said projection sections and one of said projections;

reinforcement pillars being provided with each of said first pair of opposing side walls, said reinforcement pillars extending vertically between said bottom and said shoulder, additional reinforcement pillars extending vertically between said bottom and said shoulders intermediate the corners of said bottom;

a pair of supporting elements extending downwardly from said bottom along the side walls of said first pair of opposing side walls, each of said pair of supporting elements having a bottom surface and a neck extending along the length of the supporting element at a second fixed distance above said bottom surface, said second fixed distance being at least as great as said first fixed distance.

8. The stackable crate according to claim 7, wherein said reinforcement pillars extend upwardly from the corners of said bottom.

9. The stackable crate according to claim 6, wherein said projection sections have a height which is dimensioned relative to the length of said shoulders along the side walls of said first pair of opposing side walls and the length of said supporting elements in accordance with the relationship:

$$L \geqq 1/2\sqrt{H^2 + A^2}$$

wherein:

L=the length of said shoulders,

H=the height of said projection sections, and

A=the length of said supporting elements.

10. In a stackable rectangular crate for bottles, of the type having the shape of a box with an open top, a bottom, first and second pairs of opposing side walls meeting at corners, said first pair of opposing side walls being higher than the side walls of said second pair of sidewalls, said crate being adapted to hold bottles taller than said first pair of opposing side walls, two supporting elements in the form of extensions of said first pair of opposing side walls which extend downwardly from said bottom and terminate in substantially straight horizontal edges extending along the side walls of said first pair of opposing side walls, and stacking elements at upper parts of said first pair of opposing side walls, said stacking elements having shoulders adapted to support supporting elements of another crate stacked from above, and projections extending upwardly from said first pair of opposing side walls and extending along substantially the entire length of the side walls of said first pair of opposing side walls, said projections having sections extending a short distance along the side walls of said second pair of opposing side walls at said corners, the crate thus presenting an H-shaped profile with recesses above and below said bottom which are intended for the display of bottles placed on said bottom and dimensioned to allow the picking out of bottles from any of a plurality of stacked crates, the improvement comprising:

said shoulders extending horizontally and linearly along substantially the entire length of the side walls of said first pair of opposing side walls, the side walls of said first pair of side walls being provided with a plurality of reinforcement pillars which extend substantially vertically from the shoulders of the side walls of said first pair of side walls toward said bottom, said projections being adapted to outwardly surround the supporting elements of another crate stacked from above, said shoulders and said projections being dimensioned to permit such obliquity of another crate stacked from above that its supporting elements nearest to one of the side walls of said second pair of opposing side walls are situated higher than said sections of said projections of the lower crate, while the supporting elements nearest to the other side wall of said second pair of opposing side walls continue to rest upon said shoulders of the lower crate, a subsequent shifting of the crate stacked from above in a direction parallel to the upper edges of said first pair of side walls being possible through its supporting elements sliding on said shoulders of the lower crate on said sections of said projections, said shifting being capable of being carried out without disturbance of any bottles which may be contained within said lower crate due to the combined space created between the first pair of opposing side walls of the lower crate and the two supporting elements of the upper crate.

11. A stackable crate for use in carrying and displaying bottles, comprising:

a rectangular bottom having four corners;

a first pair of opposing side walls extending upwardly from said bottom;

a second pair of opposing side walls extending upwardly from said bottom and being connected with said first pair of opposing side walls at corners extending upwardly from the corners of said bottom, said first pair of opposing side walls extending higher above said bottom than said second pair of opposing side walls, each of the side walls of said first pair of side walls having a shoulder extending along substantially the entire length thereof, a plurality of reinforcement pillars extending vertically between said bottom and said shoulder and a projection extending upwardly from said shoulder along substantially the entire length of said shoulder, said projections extending upwardly a first fixed distance and having a top surface, each of the side walls of said second pair of opposing side walls including projection sections which are connected with the projections on adjacent ones of the side walls of said first pair of opposing side walls and which extend upwardly to the same height as said projections so that teach of said shoulders is bordered by two of said projection sections and one of said projections;

a pair of supporting elements extending downwardly from said bottom along the side walls of said first pair of opposing side walls, each of said pair of supporting elements having a bottom surface and a neck extending along the length of the supporting element at a second fixed distance above said bottom surface, said second fixed distance being at least as great as said first fixed distance.

12. In a stackable rectangular crate of bottles, of the type having the shape of a box with an open top, a bottom, first and second pair of opposing side walls meeting at corners, said first pair of opposing side walls being higher than the side walls of said second pair of sidewalls, said crate being adapted to hold bottles taller than said first pair of opposing side walls, two supporting elements in the form of extensions of said first pair of opposing side walls which extend downwardly from said bottom and terminate in substantially straight horizontal edges extending along the side walls of said first pair of opposing side walls, and stacking elements at upper parts of said first pair of opposing side walls, said stacking elements having shoulder adapted to support supporting elements of another crate stacked from above, and projections extending upwardly from said first pair of opposing side walls and extending along substantially the entire length of the side walls of said first pair of opposing side walls, said projections having sections extending a short distance along the side walls of said second pair of opposing side walls at said corners, the crate thus presenting an H-shaped profile with recesses above and below said bottom which are intended for the display of bottles pale don said bottom and dimensioned to allow the picking out of bottles from any of a plurality of stacked crates, the improvement comprising:

a pair of braces extending between each of said supporting elements and said bottom, said braces being in the form of extensions of said second pair of opposing side walls and including a shape tapered away from said bottom toward said supporting elements, said shoulders extending horizontally and linearly along substantially the entire length of the side walls of said first pair of opposing side walls, said projections being adapted to outwardly surround the supporting elements of another crate stacked from above, that its supporting elements nearest to one of the side walls of said second pair of opposing side walls are situated higher than said sections of said projections of the lower crate, while the supporting elements nearest to the other side wall of said second pair of opposing side walls continue to rest upon said shoulders of the lower crate, a subsequent shifting of the crate stacked from above in a direction parallel to the upper edges of said first pair of side walls being possible through its supporting elements sliding on said shoulders of the lower crate on said sections of said projections said shifting being capable of being carried out without disturbance of any bottles which may be contained within said lower crate due to the combined space created between the first pair of opposing side walls of the lower crate and the supporting elements and braces of the upper crate.

* * * * *